US008251771B2

(12) United States Patent
Su

(10) Patent No.: US 8,251,771 B2
(45) Date of Patent: Aug. 28, 2012

(54) ELECTRONIC TOY

(75) Inventor: Xiao-Guang Su, Shenzhen (CN)

(73) Assignees: Hong Fu Jin Precision Industry (ShenZhen) Co. Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 329 days.

(21) Appl. No.: 12/569,865

(22) Filed: Sep. 29, 2009

(65) Prior Publication Data

US 2010/0297909 A1 Nov. 25, 2010

(30) Foreign Application Priority Data

May 21, 2009 (CN) ..... 2009 1 0302507

(51) Int. Cl.
*A63H 17/00* (2006.01)
*A63H 33/26* (2006.01)

(52) U.S. Cl. ..... 446/465; 446/129

(58) Field of Classification Search ..... 446/129, 446/136, 137, 431, 457, 465, 470
See application file for complete search history.

(56) References Cited

U.S. PATENT DOCUMENTS

| | | | | | |
|---|---|---|---|---|---|
| 2,842,896 | A * | 7/1958 | Sire | 446/133 |
| 3,690,393 | A * | 9/1972 | Guy | 180/65.6 |
| 3,817,518 | A * | 6/1974 | Routson | 273/456 |
| 4,011,674 | A * | 3/1977 | Jacobson | 40/426 |
| 4,571,213 | A * | 2/1986 | Ishimoto | 446/468 |
| 4,673,369 | A * | 6/1987 | DiPietro | 446/133 |
| 4,897,070 | A * | 1/1990 | Wagstaff | 446/273 |
| 5,184,970 | A * | 2/1993 | Binkley | 446/132 |
| 5,851,134 | A * | 12/1998 | Chiu | 446/468 |
| 6,309,274 | B1 * | 10/2001 | Thomson et al. | 446/165 |
| 7,297,042 | B2 * | 11/2007 | Whitehead | 446/139 |

* cited by examiner

*Primary Examiner* — Gene Kim
*Assistant Examiner* — Alyssa Hylinski
(74) *Attorney, Agent, or Firm* — Altis Law Group, Inc.

(57) ABSTRACT

An electronic toy includes a main body and a moving device disposed under the main body for moving the electronic toy. The moving device includes a fixing board, a first wheel, a second wheel, and a motor. The first wheel and the second wheel are magnetic. The first wheel is rotatably fixed to the fixing board for supporting and moving the electronic toy. The second wheel is rotatably fixed to the fixing board and facing the first wheel. The second wheel is operable to apply a magnetic torque to the first wheel when rotating relative to the first wheel, so as to rotate the first wheel. The motor is connected to the second wheel for rotating the second wheel.

12 Claims, 5 Drawing Sheets

ELECTRONIC TOY

BACKGROUND

1. Technical Field

The present disclosure relates to electronic toys and, particularly, to an electronic toy having wheels.

2. Description of Related Art

Most motor driven toy cars usually have wheels that are driven synchronously, as such, maneuvering of the toy is difficult. To solve this problem, each wheel can be independently driven by a corresponding motor. However, the cost of the electronic toy would be greatly increased.

Therefore, it is desirable to provide an electronic toy which can overcome the above-mentioned problems.

DETAILED DESCRIPTION

Embodiments of the present disclosure will now be described in detail with reference to the drawings.

Figure 1:
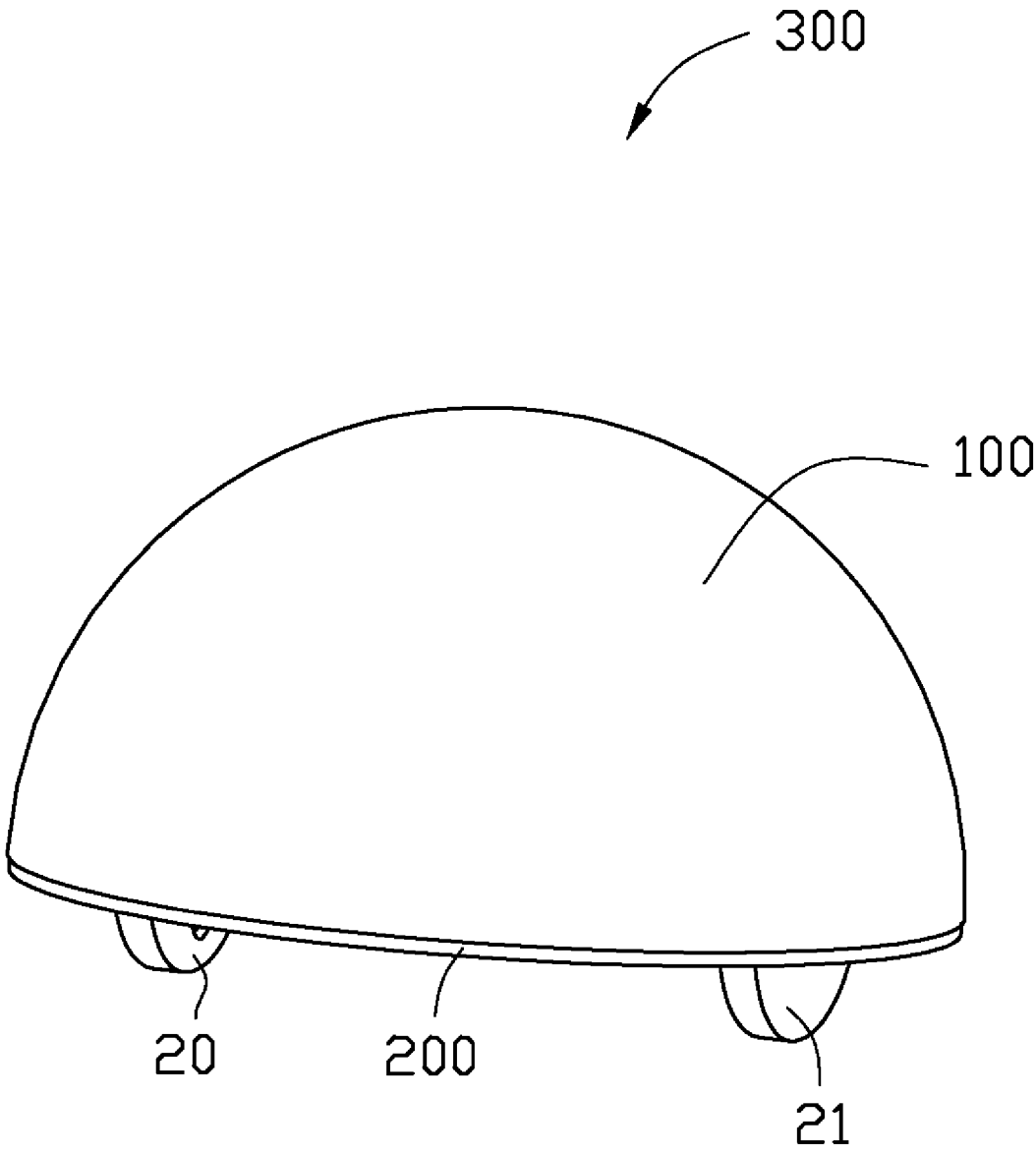
FIG. 1 is an assembled, isometric, schematic view of an electronic toy, according to an exemplary embodiment.

Referring to FIG. 1, an electronic toy 300, according to an exemplary embodiment, includes a main body 100 and a moving device 200 disposed under the main body 100.

The main body 100 is dome shaped and configured to receive various components such as a main board, a battery, and a central processing unit (CPU) (not shown).

Figure 2:
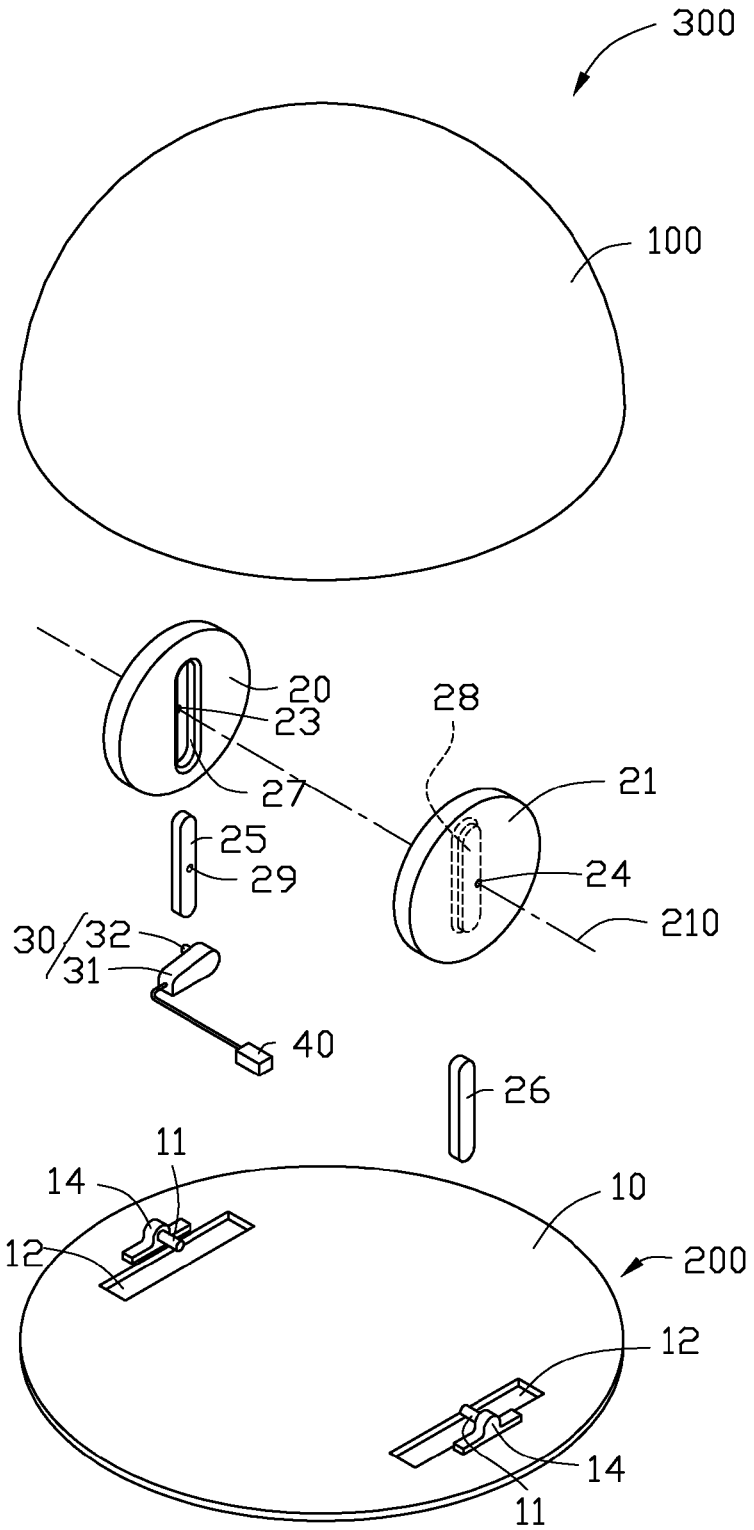
FIG. 2 is an exploded, isometric, schematic view of the electronic toy of FIG. 1.

Also referring to FIG. 2, the moving device 200 includes a fixing board 10, a first wheel 21, a second wheel 20, a motor 30, and a controller 40. The first wheel 21 and the second wheel 20 are rotatably fixed to the fixing board 10. The motor 30 and the controller 40 are disposed on the fixing board 10.

The fixing board 10 has a circular plate shape. The fixing board 10 defines two rectangular slots 12 parallel to each other. The slots 12 are configured to receive the first wheel 21 and the second wheel 20 correspondingly. The fixing board 10 includes two holders 14 and two pivot shafts 11. The holders 14 are disposed adjacent to the slots 12 correspondingly and face each other. The pivot shafts 11 are concentrically fixed to the holders 14 correspondingly, such that the pivot shafts 11 are suspended in the centers of the slots 12.

The first wheel 21 defines a central axis 210, a first receiving groove 28, and a first pivot hole 24. The central axis 210 is positioned in the center of the first wheel 21, and is substantially parallel to the pivot shafts 11. The first receiving groove 28 is defined in the center of the inner surface of the first wheel 21. The first pivot hole 24 is defined along the central axis 210 to receive a corresponding pivot shaft 11. The first wheel 21 includes a substantially rectangular first magnet 26. The first magnet 26 is received in the first receiving groove 28.

The second wheel 20 has a similar structure as the first wheel 21. The second wheel 20 defines a second pivot hole 23 and a second receiving groove 27. The second wheel 20 includes a substantially rectangular second magnet 25, which is received in the second receiving groove 27. The first magnet 26 and the second magnet 25 face each other with opposite polarities, such that the first magnet 26 and the second magnet 25 can attract each other. The second magnet 25 defines a third pivot hole 29 which is substantially concentric to the second pivot hole 23.

The motor 30 is operable to drive the second wheel 20. The motor 30 includes a stator 31 and a rotor 32. The stator 31 is operable to rotate the rotor 32 relative to the stator 31.

The controller 40 is electrically connected to the motor 30, and is operable to control the motor 30. In practice, the controller 40 can be connected to a main board received in the main body 100.

Figure 3:
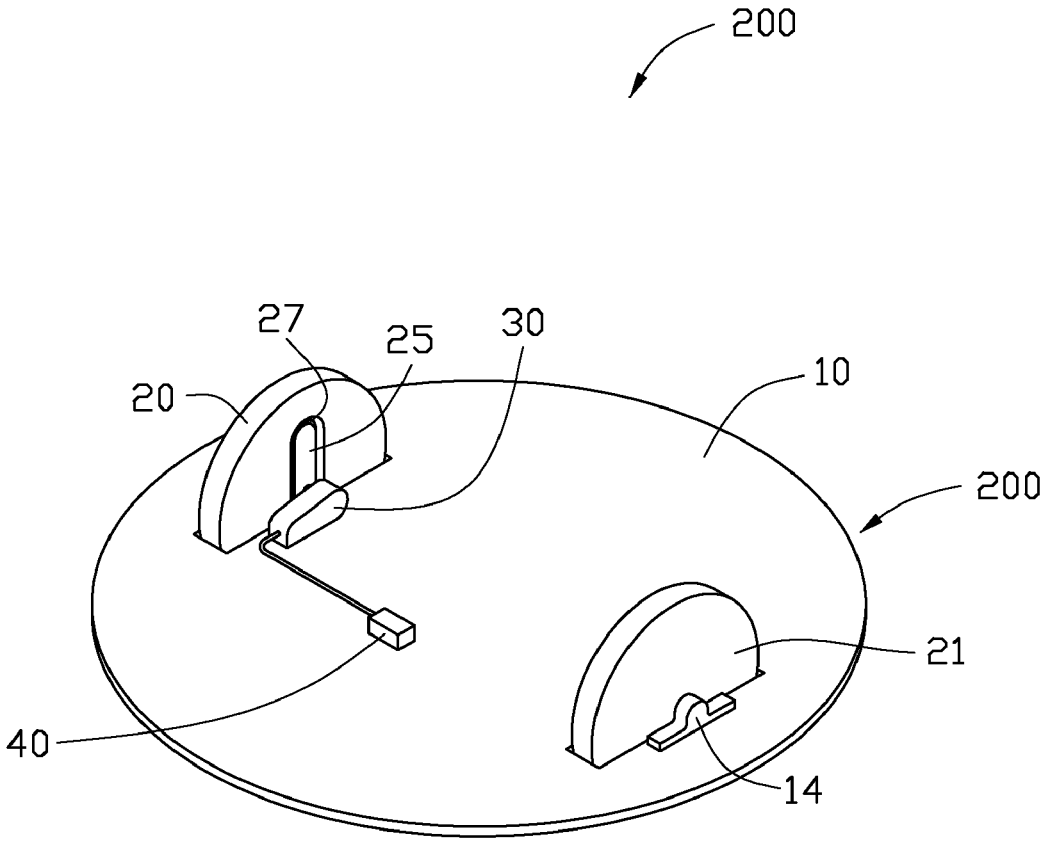
FIG. 3 is a partially assembled, isometric, schematic view of the electronic toy of FIG. 1.

Also referring to FIG. 3, in assembly, the first wheel 21 and the second wheel 20 are inserted through the slots 12 correspondingly. The first wheel 21 and the second wheel 20 partially extend out from the slots 12 to support the electronic toy 300. The pivot shafts 11 are inserted into the first pivot hole 24 and the second pivot hole 23, such that the first wheel 21 and the second wheel 20 are rotatably fixed on the fixing board 10. The first magnet 26 and the second magnet 25 face each other. Then, the rotor 32 is inserted into the third pivot hole 29, and is concentric to the pivot shafts 11. The stator 31 is disposed on the fixing board 10. The controller 40 is disposed on the fixing board 10, and is electrically connected to the motor 30. Finally, the main body 100 is fixed to the fixing board 100 and covers the first wheel 21, the second wheel 20, the motor 30, and the controller 40.

Figure 4:
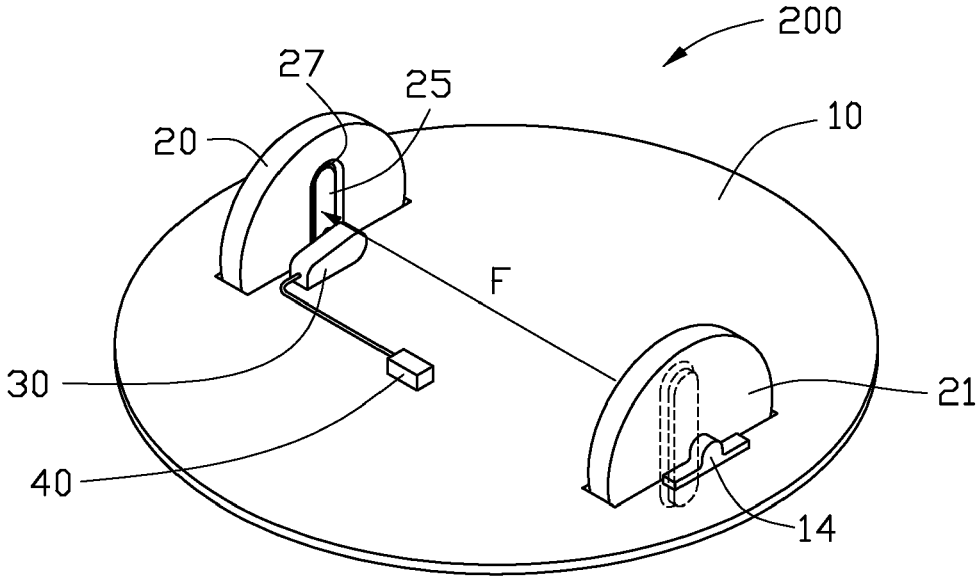
FIGS. 4 and 5 are schematic views of working states of the electronic toy of FIG. 1.
Figure 5:
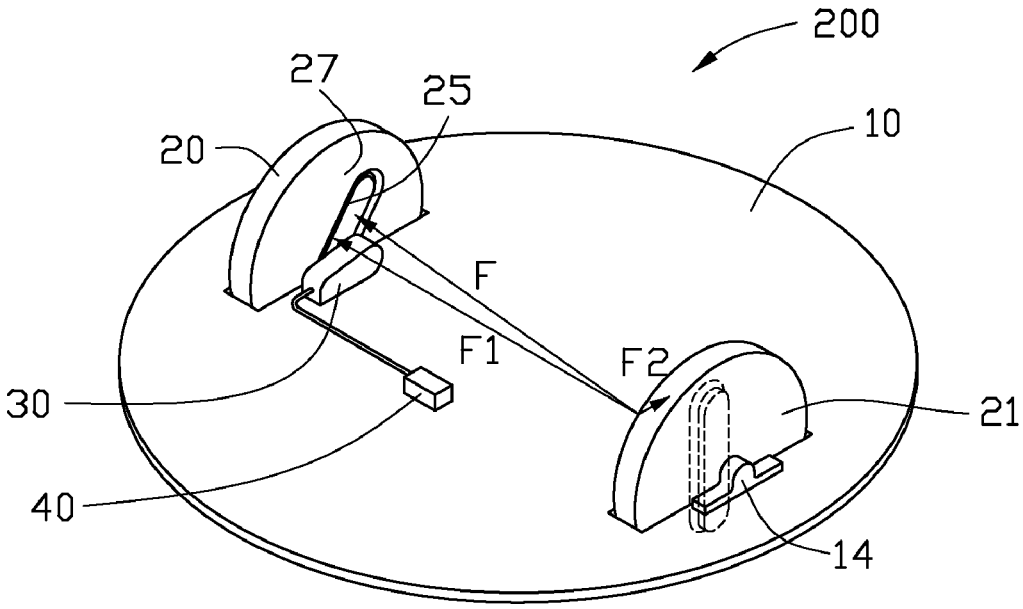

Referring to FIGS. 4 and 5, when the length of the first magnet 26 is parallel to that of the second magnet 25, the direction of an attracting force F applied to the first magnet 26 is parallel to the central axis 210 of the first wheel 21. Otherwise, the attracting force F applied to the first magnet 26 is not parallel to, i.e., forms an angle with, the central axis 210. Accordingly, when the motor 30 rotates the second wheel 20 relative to the first wheel 21, the second wheel 20 applies a torque to the first wheel 21 due to the component F2 of the attracting force F which is perpendicular to the central axis 210, thereby driving the first wheel 21 to rotate following the second wheel 20.

For the electronic toy 300 to turn around, the controller 40 controls the motor 30 to increase the torque applied to the second wheel 20 to speed up the second wheel 20. At the same time, the torque applied to the first wheel 21 by the second wheel 20 is smaller than that applied to the second wheel 20. Accordingly, the rotational speed of the first wheel 21 is less than that of the second wheel 20, so the electronic toy 300 turns toward the first wheel 21. Similarly, if the controller 40 slows the motor 30, then the second wheel 20 slows, and the electronic toy 300 turns toward the second wheel 20.

It should be understood that the electronic toy 300 is not limited to have only two wheels. In an alternative embodiment, the electronic toy 300 may includes four wheels, and two motors are connected to two wheels in one side correspondingly.

It should be also mentioned that, the two wheels can be directly disposed under the main body 100 in an alternative embodiment.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. An electronic toy, comprising:

a main body; and a moving device disposed under the main body for moving the electronic toy, the moving device comprising:

a fixing board disposed under the main body;

a magnetic first wheel rotatably fixed to the fixing board for supporting and moving the electronic toy;

a magnetic second wheel rotatably fixed to the fixing board and facing the first wheel, the second wheel being operable to apply a magnetic torque to the first wheel to rotate the first wheel; and a motor connected to the second wheel for rotating the second wheel, wherein when the motor is controlled to speed up the rotation of the second wheel, the electronic toy turns toward the first wheel, and when the motor is controlled to slow down the rotation of the second wheel, the electronic toy turns toward the second wheel.

2. The electronic toy as claimed in claim 1, wherein the first wheel and the second wheel face each other with opposite polarities, such that the first wheel and the second wheel attract each other.

3. The electronic toy as claimed in claim 1, wherein the first wheel defines a first receiving groove and comprises a first magnet received in the first receiving groove, and the second wheel defines a second receiving groove and comprises a second magnet received in the second receiving groove.

4. The electronic toy as claimed in claim 3, wherein the first magnet and the second magnet face each other with opposite polarities.

5. The electronic toy as claimed in claim 1, wherein the fixing board defines two slots, and the first wheel and the second wheel partially extend out from the two slots correspondingly.

6. The electronic toy as claimed in claim 5, wherein the fixing board comprises two holders and two pivot shafts, each of the two holders is disposed nearby a corresponding slot, each pivot shaft is disposed on a corresponding holder, and the first wheel and the second wheel are rotatably sleeved on the two pivot shafts.

7. The electronic toy as claimed in claim 1, further comprising a controller, wherein the controller is electrically connected to the motor to control the motor.

8. An electronic toy, comprising:

a main body;

a magnetic first wheel rotatably disposed under the main body for supporting the main body;

a magnetic second wheel rotatably disposed under the main body for moving the electronic toy, the second wheel being operable to apply a magnetic torque to the first wheel to rotate the first wheel; and a motor connected to the second wheel for rotating the second wheel, wherein when the motor is controlled to speed up the rotation of the second wheel, the electronic toy turns toward the first wheel, and when the motor is controlled to slow down the rotation of the second wheel, the electronic toy turns toward the second wheel.

9. The electronic toy as claimed in claim 8, wherein the first wheel and the second wheel face each other with opposite polarities, such that the first wheel and the second wheel attract each other.

10. The electronic toy as claimed in claim 8, wherein the first wheel defines a first receiving groove and comprises a first magnet received in the first receiving groove, and the second wheel defines a second receiving groove and comprises a second magnet received in the second receiving groove.

11. The electronic toy as claimed in claim 10, wherein the first magnet and the second magnet face each other with opposite polarities.

12. The electronic toy as claimed in claim 8, further comprising a controller, wherein the controller is electrically connected to the motor to control the motor.

* * * * *